United States Patent [19]

Ohba et al.

[11] Patent Number: 4,760,424

[45] Date of Patent: Jul. 26, 1988

[54] MULTIPLY SEPARABLE COPIER AND DEVELOPING APPARATUS

[75] Inventors: Harutaro Ohba; Seiji Sugimura, both of Shizuoka, Japan

[73] Assignee: Tokyo Electric Co., Ltd., Tokyo, Japan

[21] Appl. No.: 4,489

[22] Filed: Jan. 20, 1987

[30] Foreign Application Priority Data

Jan. 24, 1986 [JP] Japan ..... 61-13247
Jan. 24, 1986 [JP] Japan ..... 61-13248

[51] Int. Cl.[4] ..... G03G 15/00; G03G 15/20

[52] U.S. Cl. ..... 355/3 R; 355/3 DD; 355/3 DR; 355/3 FU

[58] Field of Search ..... 355/3 FU, 3 TR, 3 SH, 355/14 SH, 3 DR, 14 FU, 3 DD, 3 R

[56] References Cited

U.S. PATENT DOCUMENTS 3,966,316 6/1976 Pfeifer et al. .
4,284,345 8/1981 Sygiyama et al. ..... 355/3 R
4,376,577 3/1983 Okamoto .
4,376,579 3/1983 Wakao .
4,386,841 6/1983 Wakao et al. ..... 355/3 DR
4,403,851 9/1983 Yanagawa .
4,412,734 11/1983 Shibuya et al. .
4,416,536 11/1983 Itoh et al. .
4,585,324 4/1986 Koyama et al. ..... 355/3 DR X
4,696,561 9/1987 Katoh et al. ..... 355/3 FU

FOREIGN PATENT DOCUMENTS 217968 12/1983 Japan ..... 355/3 SH
104958 6/1985 Japan ..... 355/3 R
168158 8/1985 Japan ..... 355/3 R

*Primary Examiner*—R. L. Moses
*Assistant Examiner*—Ed Pipala
*Attorney, Agent, or Firm*—Oblon, Fisher, Spivak, McClelland & Maier

[57] ABSTRACT

An electrostatic photographic apparatus according to the present invention includes a lower unit, an upper unit connected for opening and closing motion to the lower unit and carrying a light source and a paper receiver thereon, a developing unit including a holding member on which a photosensitive member, a developer and a cleaning mechanism are mounted, supporting means located on the lower unit for positioning the developing unit and for removably supporting the developing unit in a vertical direction thereon, and pressing means located on the upper unit for pressing against the developing unit supported on the supporting means, whereby various mechanical components are shared by the lower unit and the upper unit. Accordingly, disassembling of the developing unit for maintenance and releasing of paper jamming can be achieved readily.

38 Claims, 6 Drawing Sheets

MULTIPLY SEPARABLE COPIER AND DEVELOPING APPARATUS

FIELD OF THE INVENTION

This invention relates to an electrostatic photographic apparatus which develops an electrostatic latent image formed on an outer periphery of a photosensitive member and transfers a thus developed image to a medium such as paper. More particularly, it relates to a device for facilitating maintenance or releasing of jamming of an apparatus of the type mentioned.

BACKGROUND OF THE INVENTION

Electrostatic photographic apparatus of the type mentioned commonly have a structure in which a potential is applied to an outer periphery of a photosensitive member in the form of a drum by means of a charger and then a thus charged layer of the photosensitive member is scanned by a beam of light in response to data of a transfer image to form an electrostatic latent image, whereafter the electrostatic latent image thus formed is transferred to paper wrapped around the photosensitive member by a transfer charger. Meanwhile, a electrostatic latent image formed on a photosensitive member must necessarily be developed before it is transferred to paper, and, to this end, a developing device is provided. The developing device includes a developer for adhering toner to an outer periphery of the photosensitive member having an electrostatic latent image formed thereon to convert the electrostatic latent image into a visible image, and a cleaning mechanism for removing remaining toner from the outer periphery of the photosensitive drum after the electrostatic latent image has been transferred to the paper. The developer and the cleaning mechanism both constituting the developing device are assembled individually and independently. The photosensitive member is also assembled independently.

Drawbacks of such conventional electrostatic photographic apparatus as described above will now be described. A photosensitive member, a cleaning mechanism and a developer are articles of consumption and are replaced comparatively frequently. However, since the photosensitive member, the developer and the cleaning mechanism are individually assembled independently, such replacement requires disassembling of each of them. Accordingly, it is a drawback that many other mounted parts may get in the way of a replacing operation of such an article of consumption, resulting in low operability in maintenance.

Meanwhile, the conventional electrostatic photographic apparatus have a structure wherein a charger, a transfer charger, a developing device and some other components are disposed closely to each other around a photosensitive member. Accordingly, it is a drawback that it is difficult to release jamming of paper which is guided between the photosensitive member and such components.

OBJECTS OF THE INVENTION

It is a first object of the present invention to provide an electrostatic photographic apparatus wherein maintenance of a photosensitive member and a developing device can be achieved easily.

It is a second object of the invention to provide an electrostatic photographic apparatus wherein releasing of jamming can be achieved easily.

SUMMARY OF THE INVENTION

In order to attain the objects described above, according to the present invention, an electrostatic photographic apparatus comprises a lower unit, an upper unit connected for opening and closing motion to the lower unit and carrying a light source and a paper receiver thereon, a developing unit including a holding member on which a photosensitive member, a developer and a cleaning mechanism are mounted, and supporting means located on the lower unit for positioning the developing unit and for removably supporting the developing unit in a vertical direction thereon. The electrostatic photographic apparatus further comprises pressing means located on the upper unit for pressing the developing unit supported on the supporting means against the supporting means when the upper unit is closed to the lower unit. For maintenance, the upper unit will be pivoted upwardly relative to the lower unit. Consequently, removal and re-mounting of the developing unit is allowed. Thus, if the developing unit is disassembled from the lower unit, then an operation for replacing the photosensitive member, the cleaning mechanism and/or the developer can be conducted in a wide operation spacing, which facilitates maintenance of the electrostatic photographic apparatus.

The electrostatic photographic apparatus may further comprise a hanging lever and operating means. The hanging lever is constructed so as to be displaceable to connect to the developing unit, and the operating means is constructed so as to displace the hanging lever to retreat from said developing unit. Thus, if the upper unit is pivoted from the lower unit while the developing unit is connected to the hanging lever, then the developing unit is hung up by the upper unit. Consequently, a spacing above the lower unit is opened, which facilitates releasing of paper jamming.

DESCRIPTION OF THE PREFERRED EMBODIMENT

Figure 1:
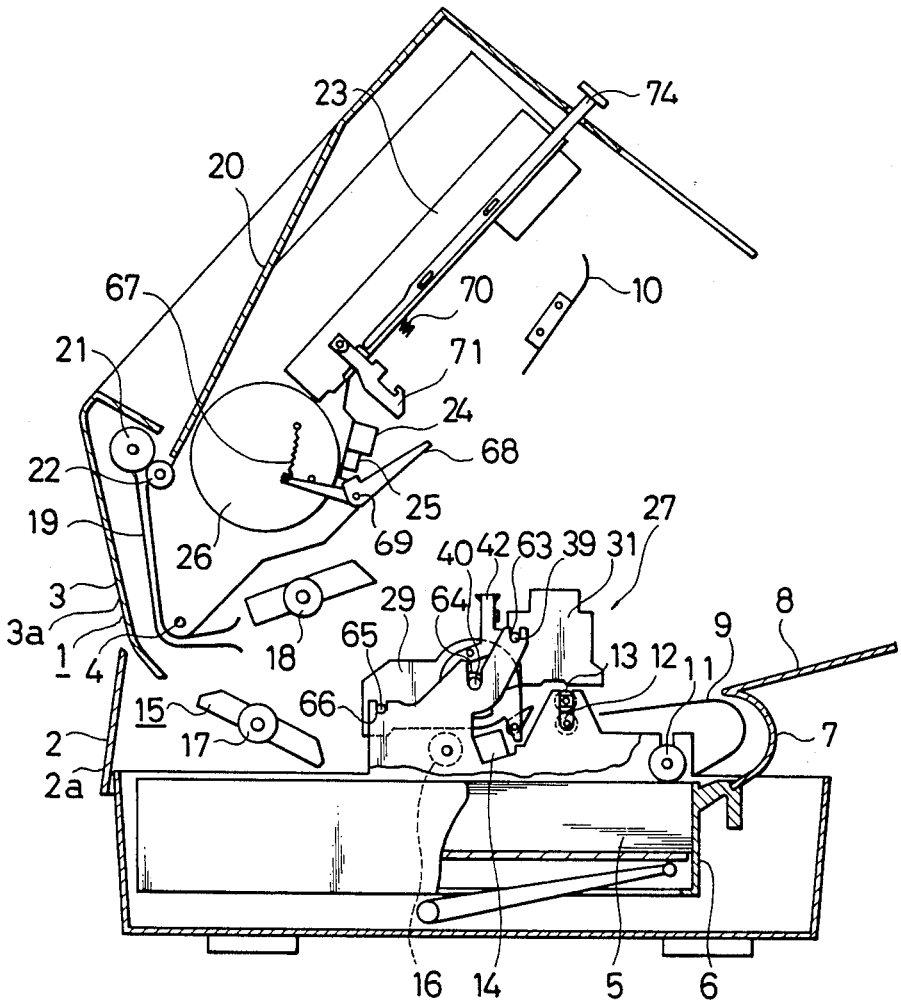
FIG. 1 is a vertical sectional side elevational view illustrating an electrostatic photographic apparatus according to an embodiment of the present invention with an upper unit opened upwardly.

Now, a preferred embodiment of the present invention will be described in detail with reference to the drawings. An electrostatic photographic apparatus according to the invention includes a housing 1 including a lower frame 2 and an upper frame 3. A support shaft 4 is mounted at rear parts of the lower frame 2 and the upper frame 3 and serves as a fulcrum to interconnect them for pivotal motion relative to each other while a clamp (not shown) for removably coupling them to each other is mounted at a front part of one of them.

A cassette case 6 is removably mounted on the bottom of the lower frame 2 from the front and has a large number of sheets of paper 5 contained in a layered condition therein. The cassette case 6 has a guide plate 7 for turning the direction of paper 5 in the U-shape, and a manual insertion tray 8. Another guide plate 9 for guiding paper 5 is located on the lower frame 2 in an opposing relationship to the guide plate 7, and a further guide plate 10 for guiding the paper 5 guided by the guide plate 9 is located on the upper frame 3 in an opposing relationship to a rear part of the guide plate 9.

Further mounted on the lower frame 2 are a paper feed roller 11 for drawing out a sheet of paper 5 from within the cassette case 6, a pair of feed rollers 12, 13 for feeding the thus drawn out paper 5 to a photosensitive drum which will be hereinafter described, a transfer charger 14, and a further feed roller 16 for introducing the paper 5 after passing the transfer charger 14 to a fixing device 15. The fixing device 15 includes a pressure roller 17 removably mounted on the lower frame 2 and a heating drive roller 18 mounted on the upper frame 3.

Meanwhile, mounted on the upper frame 3 are a guide plate 19 for guiding paper 5 after passing the fixing device 15, a pair of feed rollers 21, 22 for feeding the paper 5 to a paper receiver 20, a light source means 23 serving as a light source, a charger 24, a discharger 25, and a motor 26.

Thus, a lower unit **2*a* is constituted by the lower frame 2 on which the cassette case 6, the guide plate 9, the paper feed roller 11, the feed rollers 12, 13, the transfer charger 14, the pressure roller 17 of the fixing device 15 and the feed roller 16 are mounted. On the other hand, an upper unit 3*a* is constituted by the upper frame 3 on which the guide plate 10, the heating drive roller 18 of the fixing device 15 and the feed roller 16, the guide plate 19, the paper receiver 20, the feed rollers 21, 22, the light source means 23, the charger 24, the discharger 25 and the motor 26** are mounted.

Figure 5:
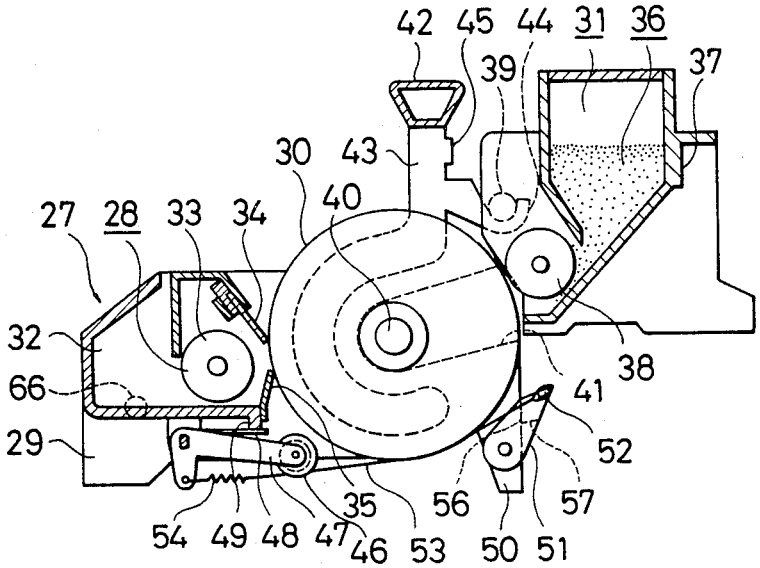
FIG. 5 is a vertical sectional side elevational view showing the developing unit.
Figure 6:
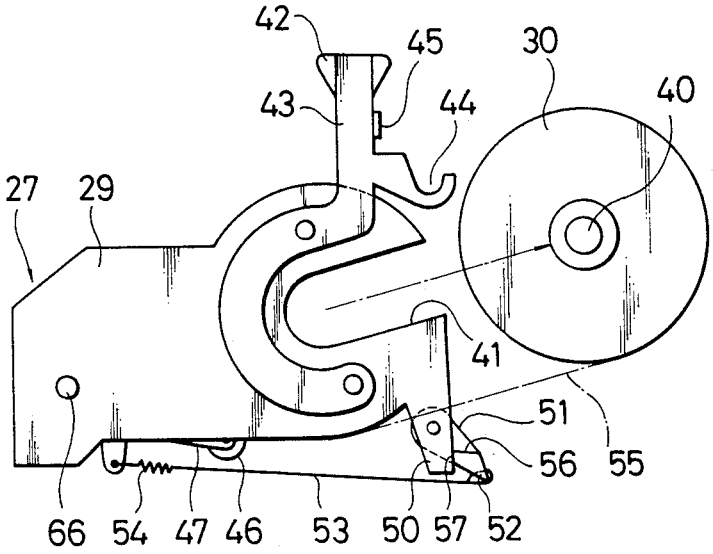
FIG. 6 is a side elevational view showing a photosensitive drum disassembled from a holding member.

A developing unit 27 is also provided. Referring to FIGS. 5 and 6, the developing unit 27 includes a holding member 29 having a cleaning mechanism 28 thereon, and a photosensitive drum 30 serving as a photosensitive member and a developer 31 both removably mounted on the holding member 29. The cleaning mechanism 28 includes a sponge roller 33 accommodated in a toner tank 32, and a blade 34 and a Mylar 35 held in contact with the photosensitive drum 30. The developer 31 includes a toner box 37 for containing toner 36 therein, and a magnet roller 38.

Here, description will be given of a structure of the holding member 29 for supporting the photosensitive drum 30 and the developer 31 thereon. A pair of shafts 39 are mounted on opposite sides of the toner box 37. A pair of U-shaped slots 41 are formed in opposite side walls of the holding member 29 for rotatbly and removabl receiving oposite shaft sections 40 of the photosensitive drum 30, and a pair of arms 43 are secured to the side walls of the holding member 29. Each of the arms 29 has an upwardly extending handle 42 thereon. The slots 41 are so shaped that they are inclined to and opened at one end thereof remote from the cleaning mechanism 28 so that the shaft sections 40 of the photosensitive drum 30 may be put into and out of the slots 41 from the open ends. Meanwhile, the arms 43 have formed thereon U-shaped hooks 44 for positioning and supporting the shafts 39 extending from the opposite sides of the toner box 37 from below, and projections 45 which extend outwardly in opposite directions. It is to be noted that the handles 42 are located on a vertical plane of the center of gravity of the developing unit 27.

A pair of exfoliating tapes 53 extend at a lower part of the holding member 29. In particular, as shown in FIG. 5, a lever 47 serving as a holding means for supporting a roller 46 thereon and another lever 51 serving as a holding means are mounted for pivotal motion in a same direction at rear and front positions, respectively, on each of the side walls of the holding member 29. While a structure for mounting the levers 47 will be hereinafter described, the levers 47 have resiliently yieldable elastic pieces 48 which are engaged with engaging portions 49 of the holding member 29 to urge the levers 47 downwardly.

Meanwhile, the levers 51 are mounted for pivotal motion on a pair of projections 50 formed integrally on the side walls of the holding member 29. Hooks 52 are integrally formed on the levers 51 and hold thereon one end of the associated one of the exfoliating tapes 53. The other ends of the exfoliating tapes 53 are mounted on the levers 47 via a pair of tension springs 54. Thus, each exfoliating tape 53 extends between one of the two pairs of levers 47, 51.

Figure 7:
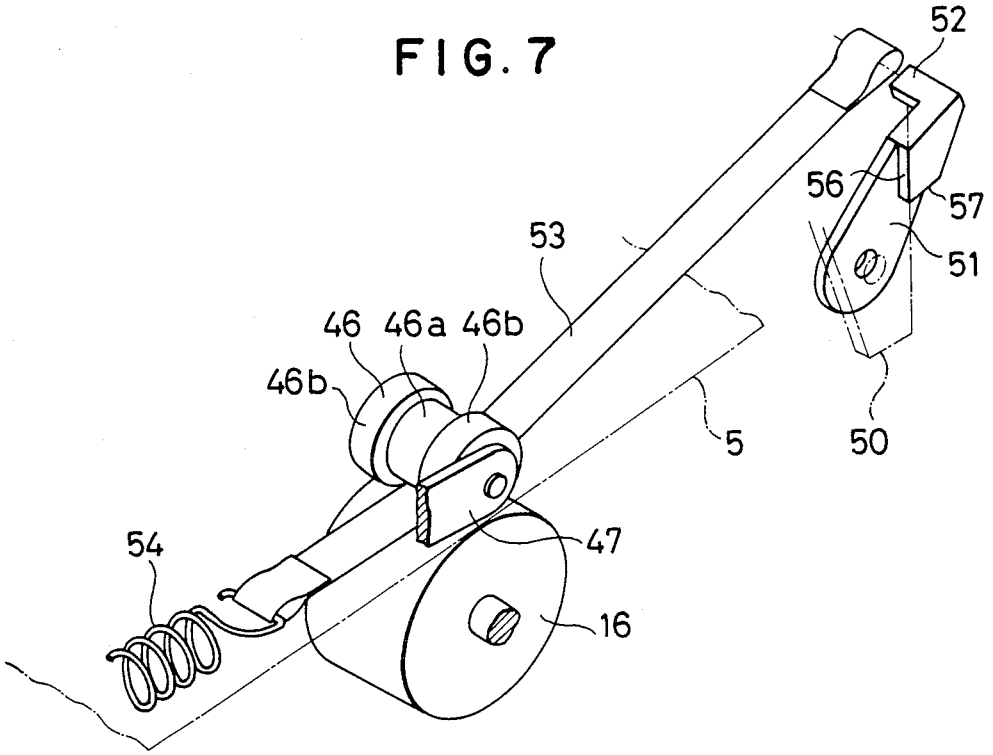
FIG. 7 is a partial perspective view showing, on an enlarged scale, a support structure for an exfoliating tape.

It is to be noted that a range of pivotal motion of the levers 51 is determined such that it may involve a range in which the levers 51 interfere with a locus 55 of movement of an outer periphery of the photosensitive drum 30 when the photosensitive drum 30 is assembled or disassembled as shown in FIGS. 5 and 6. In order to restrict the range of such pivotal motion within a predetermined fixed range, each of the levers 51 has formed thereon a pair of contacting faces 56, 57 for contacting with an edge of a corresponding one of the projections 50. Thus, the associated elements are positioned such that, when the levers 51 are pivoted until the contacting faces 56 of the levers 51 are contacted with the projections 50, the exfoliating tapes 53 may contact with the rollers 46. Here, each of the rollers 46 has, as shown in FIG. 7, a smaller diameter portion **46*a* located at the center thereof for applying a tensile force to a corresponding one of the exfoliating tapes 53, and a pair of greater diameter portions 46*b* located on opposite sides of the smaller diameter portion 46*a* for cooperating with the feed roller 16 to hold paper 5** therebetween.

Figure 8:
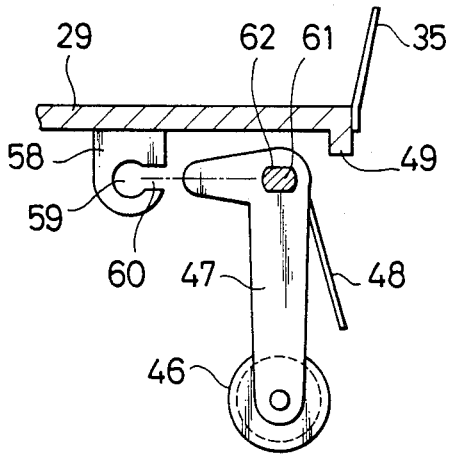
FIG. 8 is a partial vertical sectional side elevational view showing, on an enlarged scale, a mounting structure for a lever which supports a rear end of the exfoliating tape.

A structure for mounting each of the levers 47 is shown in FIG. 8. A pair of lugs 58 are formed on and extend downwardly from opposite sides of a rear part of the bottom of the holding member 29. Each of the lugs 58 has formed therein a round hole 59 and a slot 60 which communicates with the round hole 59. Meanwhile, each of the pair of left and right levers 47 has a shaft 61 formed thereon for rotatable fitting engagement with the round hole 59. The shaft 61 is partially flattened as at 62 so that it can be fitted into the round hole 59 passing the slot 60 with the flattened faces 62 thereof directed in the same orientation with the slot 60. Subsequent pivotal motion of the lever 47 will prevent the shaft 61 from being pulled off from the round hole 59 via the slot 60 of the lug 58.

Referring now to FIGS. 1 to 4, upwardly opened U-shaped recesses 63, 64, 65 serving as supporting means for supporting the developing unit 27 thereon are formed on each of opposite side walls of the lower frame 2. The recesses 63 are located so as to position and support thereon the shafts 39 extending from the opposite sides of the toner box 37, the recesses 64 are located so as to position and support thereon the shaft sections 40 of the photosensitive drum 30, and the recesses 65 are located so as to position and support thereon a pair of shafts 66 extending from the opposite side walls of the holding member 29.

A pair of pressing levers 68 are each mounted for pivotal motion around a shaft 69 on the upper unit 3*a*. Each of the pressing levers 68 is urged by a spring 67 and serves as pressing means for pressing the shaft sections 40 of the photosensitive drum 30. A pair of compression springs 70 serving also as pressing means for pressing the toner box 37 downwardly are also located on the upper unit 3*a*. A pair of hanging levers 71 for engaging with the projections 45 formed on the arms 43 are mounted for pivotal motion around shafts 73 on the upper unit 3*a* and are each urged by a spring 72. A pair of operating rods 74 for pressing the hanging levers 71 are mounted for back and forth sliding movement on the upper unit 3a.

It is to be added that a gear 75 supported on one of the shafts 39, another gear 76, and a further gear 77 secured to an end of the magnet roller 38 are located adjacent one of the opposite sides of the toner box 37. Thus, a turning force of the motor 26 is transmitted to the magnet roller 38 via the gears 75, 76, 77. The paper feed roller 11, the feed rollers 12, 16, 22 and the heating drive roller 18 are also driven by the motor 26.

With the construction described above, if an operating element not shown is operated, the photosensitive drum 30 is rotated one complete rotation while paper 5 is supplied in a synchronized relationship to an outer periphery of the photosensitive drum 30. As the photosensitive drum 30 is rotated one full rotation, the charger 24 applies a potential to the outer periphery of the photosensitive drum 30 to charge the same, and then a thus charged layer of the photosensitive drum 30 is scanned by a laser beam from the light source means 23 so that an electrostatic latent image is formed on the photosensitive drum 30. The electrostatic latent image is developed by the developer 31, and the thus developed image is transferred to the paper 5 by the transfer charger 14. Meanwhile, remaining toner adhering to the outer periphery of the photosensitive drum 30 is then removed by the cleaning mechanism 28 while the charge of the outer periphery of the photosensitive drum 30 is removed by the discharger 25. Then, the paper 5 to which the image has been transferred is fed rearwardly by the feed roller 16 and the larger diameter portions 46*b* of the rollers 46, the image is then fixed to the paper 5 by the fixing device 15, and then the paper 5 is discharged onto the paper receiver 20. In this instance, the exfoliating tapes 53 exfoliate the paper 5 on opposite sides outside an image forming area thereof from the photosensitive drum 30.

By the way, the developing unit 27 is an article of consumption. Accordingly, it must be replaced after each predetermined period of time. In such a case, at first the operating rods 74 are pressed from the front to pivot the hanging levers 71 in a clockwise direction out of engagement with the projections 45. In this condition, the upper unit 3*a* is opened upwardly around a fulcrum provided by the support shaft 4. Since in this instance the pressing levers 68 are also displaced upwardly, now the developing unit 27 is supported only in the recesses 63, 64, 65 of the side walls of the lower frame 2. Thus, the developing unit 27 can be taken up by way of the handles 42 and out to an external broader space where the photosensitive drum 30 and/or the developer 31 may be replaced by another one. In this instance, the developing unit 27 can be taken away from the lower unit 2*a* in a stable condition. This is because the handles 42 are located on a vertical plane of the center of gravity of the developing unit 27.

As details of a replacing operation, the developer 31 can be disassembled only by removing the shafts 39 from the hooks 44 of the arms 43, and the photosensitive drum 30 can be disassembled only by removing the shaft sections 40 thereof from the slots 41 of the holding member 29. To the contrary, in order to assemble them, only reverse operations must be conducted. In this manner, mounting and dismounting of the photosensitive drum 30 and/or the developer 31 can be carried out very easily without using a tool.

In this instance, due to the specific geometry of the slots 41, the photosensitive drum 30 is dismounted away from and mounted toward the cleaning mechanism 28. Consequently, when the photosensitive drum 30 is dismounted or mounted, it will not slide relative to the blade 34 or the Mylar 35 of the cleaning mechanism 28, which will prevent the photosensitive drum 30 from being damaged by the blade 34 or the Mylar 35.

It is to be added that a pair of rings (not shown) are located at opposite end portions of the magnet roller 38 for contacting engagement with opposite end portions of the photosensitive drum 30 in order to maintain the distance between the magnet roller 38 and the photosensitive drum 30 constant. Consequently, the developer 31 will not pivot around the shafts 39 and is thus held in a stabilized condition.

Actually, the cleaning mechanism 28 and the photosensitive drum 30 have substantially the same life, but the developer 31 has a greater life. Accordingly, in ordinary maintenance, the developer 31 may be removed and the photosensitive drum 30 may be scrapped together with the holding member 29 because deterioration of the cleaning mechanism proves deterioration of the photosensitive drum 30.

It is to be noted that the developing unit 27 is dismountable from and mountable on the lower unit 2*a*, and when the upper unit 3*a* is closed to the lower unit 2*a*, the developing unit 27 is held within the housing 1 in a stabilized condition. In particular, the developing unit 27 is positioned by the recesses 63, 64, 65 and supported on the lower unit 2*a*, and after the upper unit 3*a* has been closed, the developing unit is pressed by the pressing levers 68 and the compression springs 70 from above. Accordingly, the developing unit 27 is held stationarily in a stabilized condition within the housing 1.

Figure 2:
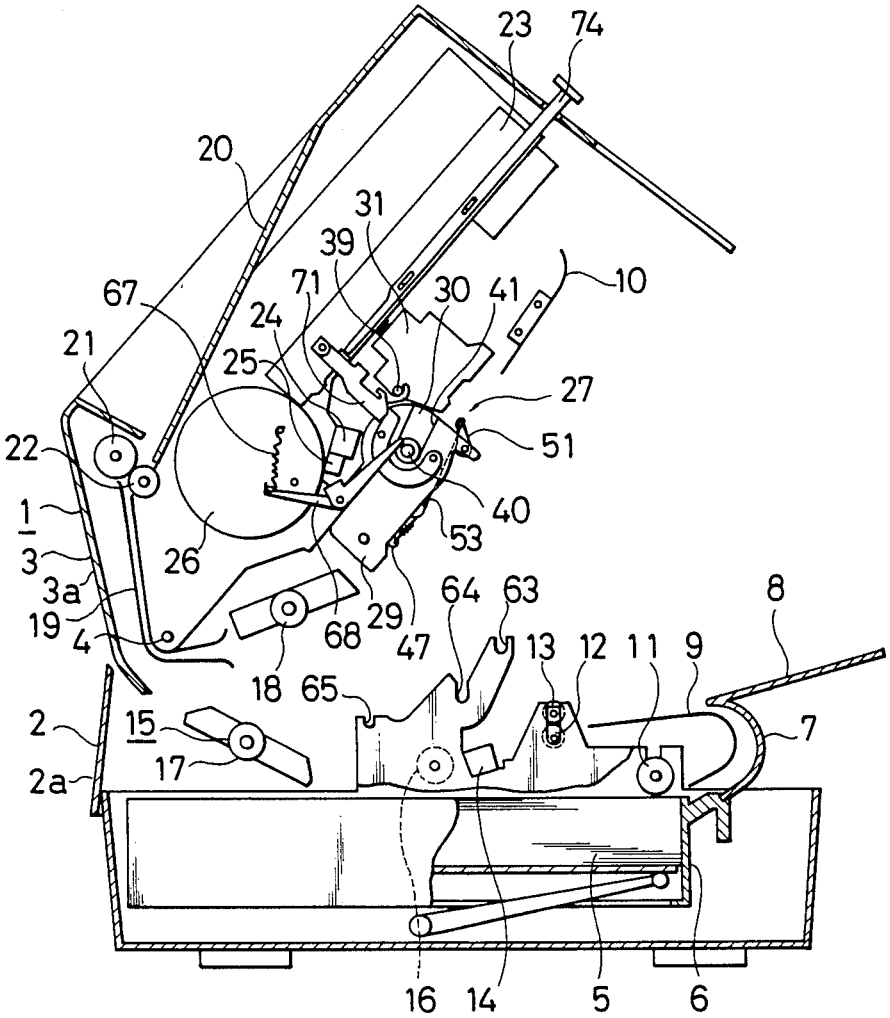
FIG. 2 is a vertical sectional side elevational view showing the electrostatic photographic apparatus of FIG. 1 with the upper unit opened upwardly together with a developing unit.
Figure 3:
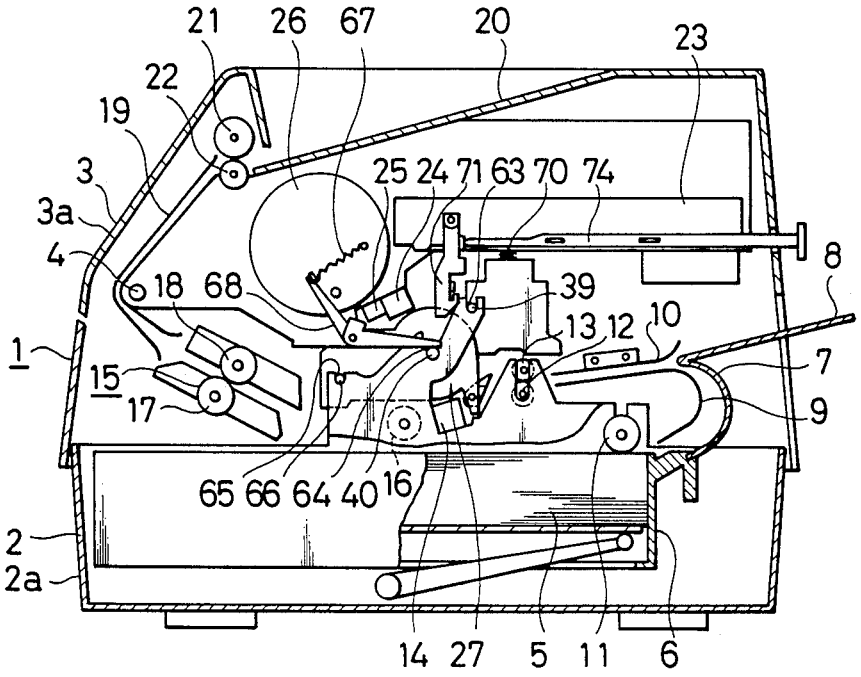
FIG. 3 is a vertical sectional side elevational view showing the electrostatic photographic apparatus of FIG. 1 with the upper unit closed downwardly.
Figure 4:
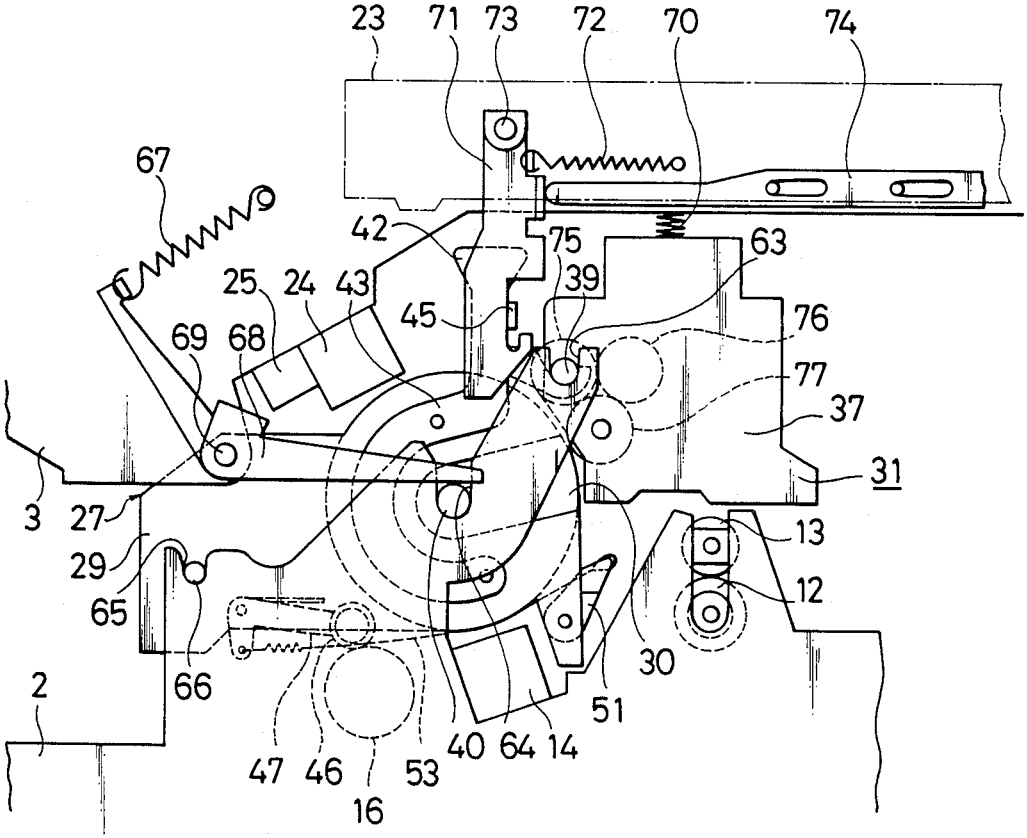
FIG. 4 is a side elevational view showing, on an enlarged scale, a support structure for the developing unit.

Meanwhile, in case paper 5 is jammed between the transfer charger 14 and the photosensitive drum 30, the upper unit 3*a* is pivoted upwardly while the operating rods 74 are not pushed. In this instance, since the hanging levers 71 remain engaged with the the projections 45 of the arms 43, the developing unit 27 is lifted together with the upper unit 3a. The developing unit 27 in a thus hung up condition is shown in FIG. 2. In this instance, the exfoliating tapes 53 are also lifted. Accordingly, a spacing above the transfer charger 14 is wide open, and hence such jamming can be released readily. To the contrary, in case paper 5 is jammed at the fixing device 15, the paper 5 can be taken away readily because the heating drive roller 18 is lifted together with the upper unit 3a to open a spacing above the pressure roller 17. In addition, such components of the apparatus as the cassette case 6, the fixing device 15 and the light source means 23 are shared by the lower unit 2a and the upper unit 3a. Accordingly, if the upper unit 3a is opened, then components of the lower unit 2a are reduced, which will further facilitate releasing of jamming.

It is to be noted that the apparatus may be alternatively constructed in practice such that if the operating rods 74 are not operated, the developing unit 27 remain supported in the recesses 63, 64, 65 of the lower unit 2a, but if the operating rods 74 are operated, then the developing unit 27 is hung up by the upper unit 3a. In such a case, particularly the apparatus may be constructed such that the hanging levers 71 and the projections 45 are normally held out of engagement with each other, and when the operating rods 74 are operated, the hanging levers 71 and the projections 45 are engaged with each other.

What is claimed is:

1. An electrostatic photographic apparatus, comprising:

a lower unit which at least contains therein a cassette case in which paper is held in a layered condition;

an upper unit connected for pivotal motion around an end of said lower unit and having at least a paper receiver thereon;

a developing unit including a holding member on which at least a photosensitive member, a developer and a cleaning mechanism are mounted;

supporting means provided on said lower unit for positioning said developing unit and for removably supporting said developing unit in a vertical direction thereon; and pressing means provided on said upper unit for pressing said developing unit against said supporting means when said upper unit is closed to said lower unit.

2. An electrostatic photographic apparatus according to claim 1, wherein said pressing means includes a spring for resiliently pressing said developing unit against said supporting means.

3. An electrostatic photographic apparatus according to claim 1, wherein said cleaning mechanism is fixedly mounted on said holding member of said developing unit while said photosensitive member and said developer are removably mounted on said holding member.

4. An electrostatic photographic apparatus according to claim 3, wherein said photosensitive member and said developer are removably supported on said holding member from above, and said pressing means includes a pressing member for pressing against a shaft of said photosensitive member, and a spring for pressing against said developer.

5. An electrostatic photographic apparatus according to claim 3, further comprising a pair of exfoliating tapes located between said photosensitive drum and a sheet of paper guided by said photosensitive drum and extending along opposite edges of the sheet of paper, said holding member having a pair of opposite side walls in each of which a slot for receiving a shaft of said photosensitive drum for rotation therein is formed such that said shaft of said photosensitive drum may be put into said slots in a direction along said exfoliating tapes from remote ends of said side walls of said holding member from said cleaning mechanism, said side walls of said holding member having holding means for holding and pulling opposite ends of said exfoliating tapes.

6. An electrostatic photographic apparatus according to claim 5, wherein said exfoliating tapes are stretched between two pairs of said holding means each via a tension spring, one of said holding means in each of the two pair being mounted for pivotal motion in a direction toward and away from said photosensitive member.

7. An electrostatic photographic apparatus comprising:

(a) a lower unit which at least contains therein a cassette case in which, during use, paper is held in a layered condition;

(b) an upper unit connected for pivotal motion around an end of said lower unit and having at least a paper receiver thereon;

(c) a developing unit including a holding member on which at least a photosensitive member, a developer, and a cleaning mechanism are mounted;

(d) supporting means provided on said lower unit for positioning said developing unit and for removably supporting said developing unit in a vertical direction thereon;

(e) pressing means provided on said upper unit for pressing said developing unit against said supporting means when said upper unit is closed to said lower unit; and (f) a fixing device including a heating drive roller and a pressure roller, said heating drive roller being mounted on one of said lower unit and said upper unit while said pressure roller is mounted on the other of said lower unit and said upper unit, whereby said heating drive roller and said pressure roller are engaged with or disengaged from each other in response to pivotal motion of said upper unit relative to said lower unit.

8. An electrostatic photographic apparatus according to claim 7, wherein said pressing means includes a spring for resiliently pressing said developing unit against said supporting means.

9. An electrostatic photographic apparatus according to claim 1, wherein said cleaning mechanism is fixedly mounted on said holding member of said developing unit while said photosensitive member and said developer are removably mounted on said holding member.

10. An electrostatic photographic apparatus according to claim 9, wherein:

(a) said photosensitive member is a photosensitive drum;

(b) said electrostatic photographic apparatus further comprises a pair of exfoliating tapes located between said photosensitive drum and a sheet of paper guided by said photosensitive drum and extending along opposite edges of the sheet of paper;

(c) said holding member has a pair of opposite side walls in each of which a slot for receiving a shaft of said photosensitive drum for rotation therein is formed such that said shaft of said photosensitive drum may be put into said slots in the direction along said exfoliating tapes from remote ends of said side walls of said holding member from said cleaning mechanism; and (d) said side walls of said holding member have holding means for holding and pulling opposite ends of said exfoliating tapes.

11. An electrostatic photographic apparatus according to claim 10, wherein said exfoliating tapes are stretched between two pairs of said holding means each via a tension spring, one of said holding means in each of the two pairs being mounted for pivotal motion in a direction toward and away from said photosensitive drum.

12. An electrostatic photographic apparatus according to claim 7, wherein:

(a) said photosensitive member and said developer are removably supported on said holding member from above and (b) said pressing means includes a pressing member for pressing against a shaft of said photosensitive member and a spring for pressing against said developer.

13. An electrostatic photographic apparatus comprising:

(a) a lower unit which at least contains therein a cassette case in which, during use, paper is held in a layered condition;

(b) an upper unit connected for pivotal motion around an end of said lower unit and having at least a paper receiver thereon;

(c) a developing unit including a holding member on which at least a photosensitive member, a developer, and a cleaning mechanism are mounted;

(d) supporting means provided on said lower unit for positioning said developing unit and for removably supporting said developing unit in a vertical direction thereon; and (e) pressing means provided on said upper unit for pressing said developing unit against said supporting means when said upper unit is closed to said lower unit, wherein:

(f) said cleaning mechanism is fixedly mounted on said holding member of said developing unit;

(g) said photosensitive member and said developer are removably mounted on said holding member;

(h) said photosensitive member and said developer are removably supported on said holding member from above; and (i) said pressing means includes a pressing member for pressing against a shaft of said photosensitive member and a spring for pressing against said developer.

14. An electrostatic photographic apparatus according to claim 13, and further comprising a fixing device including a heating drive roller and a pressure roller, said heating drive roller being mounted on one of said lower unit and said upper unit while said pressure roller is mounted on the other of said lower unit and said upper unit, whereby said heating drive roller and said pressure roller are engaged with or disengaged from each other in response to pivotal motion of said upper unit relative to said lower unit.

15. An electrostatic photographic apparatus according to claim 13, wherein said pressing means includes a spring for resiliently pressing said developing unit against said supporting means.

16. An electrostatic photographic apparatus according to claim 13, wherein:

(a) said photosensitive means is a photosensitive drum;

(b) said electrostatic photographic apparatus further comprises a pair of exfoliating tapes located between said photosensitive drum and a sheet of paper guided by said photosensitive drum and extending along opposite edges of the sheeted paper;

(c) said holding member has a pair of opposite side walls in each of which a slot for receiving a shaft of said photosensitive drum for rotation therein is formed such that said shaft of said photosensitive drum may be put into said slots in a direction along said exfoliating tapes from remote ends of said side walls of said holding member from said cleaning mechanism; and (d) said side walls of said holding member have holding means for holding and pulling opposite ends of said exfoliating tapes.

17. An electrostatic photographic apparatus according to claim 16, wherein said exfoliating tapes are stretched between two pairs of said holding means each via a tension spring, one of said holding means in each of the two pairs being mounted for pivotal motion in a direction toward and away from said photosensitive drum.

18. An electrostatic photographic apparatus comprising:

(a) a lower unit which at least contains therein a cassette case in which, during use, paper is held in a layered condition;

(b) an upper unit connected for pivotal motion around an end of said lower unit and having at least a paper receiver thereon;

(c) a developing unit including a holding member on which at least a photosensitive member, a developer, and a cleaning mechanism are mounted;

(d) supporting means provided on said lower unit for positioning said developing unit and for removably supporting said developing unit in a vertical direction thereon; and (e) pressing means provided on said upper unit for pressing said developing unit against said supporting means when said upper unit is closed to said lower unit, wherein:

(f) said cleaning mechanism is fixedly mounted on said holding member of said developing unit;

(g) said photosensitive member and developer are removably mounted on said holding member;

(h) said photosensitive member is a photosensitive drum;

(i) said electrostatic photographic apparatus further comprises a pair of exfoliating tapes located between said photosensitive drum and a sheet of paper guided by said photosensitive drum and extending along opposite edges of the sheet of paper;

(j) said holding member has a pair of opposite side walls in each of which a slot for receiving a shaft of said photosensitive drum for rotation therein is formed such that said shaft of said photosensitive drum may be put into said slots in a direction along said exfoliating tapes from remotes ends of said side walls of said holding member from said cleaning mechanism;

(k) said side walls of said holding member have holding means for holding and pulling opposite ends of said exfoliating tapes; and (l) said exfoliating tapes are stretched between two pairs of said holding means each via a tension spring, one of said holding means in each of the two pairs being mounted for pivotal motion in a direction toward and away from said photosensitive drum.

19. An electrostatic photographic apparatus according to claim 18, and further comprising a fixing device including a heating drive roller and a pressure roller, said heating drive roller being mounted on one of said lower unit and said upper unit while said pressure roller is mounted on the other of said lower unit and said upper unit, whereby said heating drive roller and said pressure roller are engaged with or are disengaged from each other in response to pivotal motion of said upper unit relative to said lower unit.

20. An electrostatic photographic apparatus according to claim 18, wherein said pressing means includes a spring for resiliently pressing said developing unit against said supporting means.

21. An electrostatic photographic apparatus according to claim 18, wherein:

(a) said photosensitive member and said developer are removably supported on said holding member from above and (b) said pressing means includes a pressing member for pressing against a shaft of said photosensitive member and a spring for pressing against said developer.

22. An electrostatic photographic apparatus, comprising:

a lower unit;

an upper unit connected for pivotal motion between a closed position and an open position around an end of said lower unit;

a light source located either one of said lower unit and said upper unit;

a developing unit including a holding member on which at least one photosensitive member, a developer, and a cleaning mechanism are mounted;

supporting means provided on said lower unit for positioning said developing unit and for removably supporting said developing unit in a vertical direction thereon;

hanging means mounted on said upper unit for hanging said developing unit supported on said supporting means to said upper unit in accordance with the moving of said upper unit from said closed position to said open position; and operating means for selectively hanging said developing unit to said hanging means.

23. An electrostatic photographic apparatus according to claim 22, wherein said cleaning mechanism is fixedly mounted on said holding member of said developing unit while said photosensitive member and said developer are removably mounted on said holding member.

24. An electrostatic photographic apparatus according to claim 22, wherein said coupling means includes a hanging lever which is displaceable to connect to said developing unit, and said operating means is constituted to displace said hanging lever to selectively retreat from said developing unit.

25. An electrostatic photographic apparatus according to claim 24, wherein said developing unit has a projection formed thereon, and said hanging lever is constituted to be urged toward and into engagement with said projection of said developing unit while said operating means is constituted such that it may press said hanging lever to displace in a direction to disengage from said projection.

26. An electrostatic photographic apparatus according to claim 22, wherein said cleaning mechanism is fixedly mounted on said holding member of said developing unit while said photosensitive member and said developer are removably mounted on said holding member.

27. An electrostatic photographic apparatus according to claim 26, wherein said supporting means has recesses for removably supporting therein a shaft of said photosensitive member and said developer from above, and further comprising pressing means including a pressing member for pressing against said shaft of said photosensitive member, said pressing means further including a spring for pressing against said developer.

28. An electrostatic photographic apparatus according to claim 26, further comprising a pair of exfoliating tapes located between said photosensitive drum and a sheet of paper guided by said photosensitive drum and extending along opposite edges of the sheet of paper, said holding member having a pair of opposite side walls in each of which a slot for receiving a shaft of said photosensitive drum for rotation therein is formed such that said shaft of said photosensitive drum may be put into said slots in a direction along said exfoliating tapes, said side walls of said holding member having holding means for holding and pulling opposite ends of said exfoliating tapes.

29. An electrostatic photographic apparatus according to claim 28, wherein said exfoliating tapes are stretched between two pairs of said holding means each via a tension spring, one of said holding means in each of the two pair being mounted for pivotal motion in a direction toward and away from said photosensitive member.

30. An electrostatic photographic apparatus comprising:

(a) a lower unit;

(b) an upper unit connected for pivotal motion around an end of said lower unit;

(c) a light source located in one of said lower unit and said upper unit;

(d) a developing unit including a holding member on which at least a photosensitive member, a developer, and a cleaning mechanism are mounted;

(e) supporting means provided on said lower unit for positioning said developing unit and for removably supporting said developing unit in a vertical direction thereon;

(f) coupling means mounted on said upper unit for selectively coupling said developing unit supported on said supporting means to said upper unit; and (g) operating means for operating said coupling means, wherein (h) said cleaning mechanism is fixedly mounted on said holding member of said developing unit;

(i) said photosensitive member and said developer are removably mounted on said holding member;

(j) said supporting means has recesses for removably supporting thereon a shaft of said photosensitive member and said developer from above; and (k) said electrostatic photographic apparatus further comprises pressing means including a pressing member for pressing against said shaft of said photosensitive member, said pressing means further including a spring for pressing against said developer.

31. An electrostatic photographic apparatus according to claim 30, wherein:

(a) said coupling means includes a hanging lever which is displaceable to connect to said developing unit and (b) said operating means is constituted to displace said hanging lever to selectively retreat from said developing unit.

32. An electrostatic photographic apparatus according to claim 31 wherein:

(a) said developing unit has a projection formed thereon;

(b) said hanging lever is constituted to be urged toward and into engagement with said projection of said developing unit; and (c) said operating means is constituted such that it may press said hanging lever to displace it in a direction to disengage from said projection.

33. An electrostatic photographic apparatus according to claim 30, wherein:

(a) said photosensitive member is a photosensitive drum;

(b) said electrostatic photographic apparatus further comprises a pair of exfoliating tapes located between said photosensitive drum and a sheet of paper guided by said photosensitive drum and extending along opposite edges of the sheet of paper;

(c) said holding member has a pair of opposite side walls in each of which a slot for receiving a shaft of said photosensitive drum for rotation therein is formed such that said shaft of said photosensitive drum may be put into said slots in a direction along said exfoliating tape; and (d) said side walls of said holding member have holding means for holding and pulling opposite ends of said exfoliating tapes.

34. An electrostatic photographic apparatus according to claim 33, wherein said exfoliating tapes are stretched between two pairs of said holding means each via a tension spring, one of said holding means in each of the two pairs being mounted for pivotal motion in a direction toward and away from said photosensitive member.

35. An electrostatic photograph apparatus comprising:

(a) a lower unit;

(b) an upper unit connected for pivotal motion around an end of said lower unit;

(c) a light source located in one of said lower unit and said upper unit;

(d) a developing unit including a holding member on which at least a photosensitive member, a developer, and a cleaning mechanism are mounted;

(e) supporting means provided on said lower unit for positioning said developing unit and for removably supporting said developing unit in a vertical direction thereon;

(f) coupling means mounted on said upper unit for selectively coupling said developing unit supported on said supporting means to said upper unit; and (g) operating means for operating said coupling means, wherein:

(h) said cleaning mechanism is fixedly mounted on said holding member of said developing unit;

(i) said photosensitive member and said developer are removably mounted on said holding member;

(j) said photosensitive member is a photosensitive drum;

(k) said electrostatic photographic apparatus further comprises a pair of exfoliating tapes located between said photosensitive drum and a sheet of paper guided by said photosensitive drum and extending along opposite edges of the sheet of paper;

(l) said holding member has a pair of opposite side walls in each of which a slot for receiving a shaft of said photosensitive drum for rotation therein is formed such that said shaft of said photosensitive drum may be put into said slots in the direction along said exfoliating tapes;

(m) said side walls of said holding member have holding means for holding and pulling opposite ends of said exfoliating tapes; and (n) said exfoliating tapes are stretched between two pairs of said holding means each via a tension spring, one of said holding means in each of the two pairs being mounted for pivotal motion in a direction toward and away from said photosensitive drum.

36. An electrostatic photographic apparatus according to claim 35, wherein:

(a) said coupling means includes a hanging lever which is displaceable to connect to said developing unit and (b) said operating means is constituted to displace said hanging lever to selectively retreat from said developing unit.

37. An electrostatic photographic apparatus according to claim 36, wherein:

(a) said developing unit has a projection formed thereon;

(b) said hanging lever is constituted to be urged toward and into engagement with said projection of said developing unit; and (c) said operating means is constituted such that it may press said hanging lever to displace it in a direction to disengage from said projection.

38. An electrostatic photographic apparatus according to claim 35, wherein:

(a) said supporting means has recesses for removably supporting thereon a shaft of said photosensitive drum and said developer from above:

(b) said electrostatic photographic apparatus further comprises pressing means including a pressing member for pressing against said shaft of said photosensitive member; and (c) said pressing means further includes a spring for pressing against said developer.

* * * * *